US008424250B2

(12) United States Patent
Platts

(10) Patent No.: US 8,424,250 B2
(45) Date of Patent: Apr. 23, 2013

(54) METHOD AND APPARATUS FOR RETROFIT CONNECTION OF ROOF TO WALL

(75) Inventor: Robert E. Platts, Ottawa (CA)

(73) Assignee: Building Performance Americas Ltd., Grand Cayman (KY)

( * ) Notice: Subject to any disclaimer, the term of this patent is extended or adjusted under 35 U.S.C. 154(b) by 369 days.

(21) Appl. No.: 12/607,154

(22) Filed: Oct. 28, 2009

(65) Prior Publication Data

US 2010/0043310 A1 Feb. 25, 2010

Related U.S. Application Data

(63) Continuation-in-part of application No. 11/748,588, filed on May 15, 2007, now abandoned.

(51) Int. Cl.
*E04B 7/04* (2006.01)
*E04B 1/38* (2006.01)
*E04B 1/00* (2006.01)

(52) U.S. Cl.
USPC ..... 52/92.2; 52/92.1; 52/93.1; 52/93.2; 52/712; 52/745.21; 52/713

(58) Field of Classification Search ..... 52/92.1, 52/92.2, 93.1, 93.2, 712, 745.21, 713
See application file for complete search history.

(56) References Cited

U.S. PATENT DOCUMENTS 874,514 A 12/1907 Lindow
2,911,690 A * 11/1959 Sanford ..... 403/232.1
3,000,145 A * 9/1961 Fine ..... 52/699
3,752,512 A 8/1973 Gilb
4,525,972 A 7/1985 Palacio et al.
4,714,372 A 12/1987 Commins
4,896,985 A * 1/1990 Commins ..... 403/11
5,150,553 A * 9/1992 Commins et al. ..... 52/264
5,257,483 A 11/1993 Netek
5,311,708 A 5/1994 Frye
5,319,896 A 6/1994 Winger
5,560,156 A 10/1996 McDonald
5,595,031 A 1/1997 Commins
5,641,240 A 6/1997 Grieser et al.
5,732,524 A * 3/1998 Kalker et al. ..... 52/712
5,836,131 A 11/1998 Viola et al.
5,870,861 A * 2/1999 Gnaedinger ..... 52/93.1
5,970,677 A 10/1999 Masters et al.
6,094,880 A 8/2000 Thompson
6,230,467 B1 5/2001 Leek
6,295,781 B1 10/2001 Thompson
6,301,855 B1 10/2001 Aerni
(Continued)

OTHER PUBLICATIONS

Simpson Strong-Tie Wood Construction Connectors Catalogue C2005 (Internet address http://wwwstrongtie.com) (uploaded in 5 parts to EFS-Web due to the size of the document).

*Primary Examiner* — William Gilbert
*Assistant Examiner* — Omar Hijaz
(74) *Attorney, Agent, or Firm* — Hiscock & Barclay LLP

(57) ABSTRACT

An apparatus for retrofit connection of a roof frame to a support member therebelow includes a claw member having a load bearing flange to be driven into an interface between a roof sheathing and a top edge of the roof frame, and a tie-down member to be mounted to a vertical surface of the support member. The tie-down member is connected to the claw member to allow various angular positions of the load bearing flange depending on roof slopes.

20 Claims, 4 Drawing Sheets

U.S. PATENT DOCUMENTS 6,658,806 B1 12/2003 Leek
6,662,517 B1 12/2003 Thompson
6,718,698 B1 4/2004 Thompson
6,763,634 B1 7/2004 Thompson
7,356,973 B2 * 4/2008 Roesset et al. ..... 52/712
2004/0107653 A1 * 6/2004 Collie ..... 52/92.2
2006/0026907 A1 * 2/2006 Gilstrap et al. ..... 52/92.2
2006/0213131 A1 * 9/2006 Butzer ..... 52/92.2

* cited by examiner

METHOD AND APPARATUS FOR RETROFIT CONNECTION OF ROOF TO WALL

CROSS-REFERENCE TO RELATED APPLICATIONS

This is a Continuation-in-Part application based on pending U.S. patent application Ser. No. 11/748,588, filed on May 15, 2007.

TECHNICAL FIELD

The present invention relates to reinforcement of wooden roof structures of houses and low-rise buildings, and more particularly to a retrofitting apparatus and method for reinforcement of roof frame structures.

BACKGROUND OF THE INVENTION

Many millions of houses and small buildings located in hurricane or tornado risk areas are at high risk of damage from the strong winds of hurricanes or tornadoes. Recent studies of hurricane damage indicate that the most extensive damage to a house occurs when the roof is torn off, allowing the rain which often accompanies strong winds to ruin the contents of the house, and often allowing walls to collapse.

There is a great need for affordable retrofitting methods for reinforcement of the connection of wooden roof frames to underlying walls. While prior art connectors of steel strip tie-down types excel as affordable connectors of roof structures to underlying walls in new construction of houses and small buildings, they are not as applicable to retrofitting of existing roof frame structures. Such connectors pose difficulties in retrofitting applications because an upper portion of the steel-strip tie should extend over the top of a rafter/truss and down the other side in order to ensure adequate tie-down strength, by applying the restraining force mainly at the top of the roof frame as compression across the grain, which wood withstands quite well. If the tie-down connectors are simply nailed into the side of the rafter/truss, as is common in the prior art, localized tensions are induced across the grain of the wood such that the rafter/truss member tends to split under high uplift pressures, which can release the connector's nails. This weakness is of special concern in the southern part of the U.S. "hurricane belt", where roof slopes are typically low, which both exacerbates wind uplift forces while subjecting the wood to tension more directly across the grain.

The over-the-top method is now widely recommended or required in the "Hurricane Belt" of the United States, even for retrofits of existing buildings. During retrofitting however, accessing the top portion of the rafter/truss requires removal and re-installation of an area of roofing and sheathing, which are laborious and costly operations, and as such, tend to discourage such retrofit upgrading of existing housing and building stock.

Prior art efforts to devise retrofits for reinforcement of roof structures have also been made. A number of United States patents as examples of such efforts are briefly discussed below.

In U.S. Pat. No. 5,257,483 (Netek) discloses some of the complications of retrofitting by installing anchor points in fascia and the wall below, allowing temporary placement of ties in the event of an impending storm. Winger, in U.S. Pat. No. 5,319,816, and several other inventors, disclose various temporary arrangements of multiple cables or nets over the roof which are anchored to the ground. Such temporary devices demand that the householder be at home and ready to react to storm warnings quickly and competently.

In U.S. Pat. No. 5,311,708, Frye shows a retrofit roof tie-down method in which lag screws are installed upwardly through an angled steel plate into the lower edges of the rafter/trusses, a lower leg of the angled steel plate being lag-screwed into the underlying wall. Frye's lag screws into the narrow edge of the rafter/truss however invite splitting and cause tension failure. Furthermore, only the screws near the junction of rafter/trusses with the top of the wall would contribute effectively, and the usual absence of a stud directly under a rafter/truss would leave Frye's wall lag screws rather ineffective.

Thompson, in U.S. Pat. No. 6,763,634, tries to resolve the retrofit problem by inserting ties down through the roofing and sheathing from above, with one strip on each side of the rafter/truss to form a saddle across it, which is able to effectively hold down the roofing and sheathing together with the rafter/truss. Thompson's ties extend down to connect to the underlying wall below. All this entails laborious and uncertain sealing of the roof penetrations, and interferes with any subsequent re-roofing job.

Therefore, there is a need for an improved retrofitting apparatus and method for reinforcement of roof frame structures.

SUMMARY OF THE INVENTION

In accordance with one aspect of the present invention, there is an apparatus in combination with a wood frame roof structure, for retrofit connection of a roof frame to a support member below the roof frame, the apparatus comprising a claw member having a substantially flat plate pressing flat against a side surface of the roof frame, and a substantially flat load bearing flange integrated with a top edge of the plate and extending transversely away from the plate to form a free extremity end, the load bearing flange being driven substantially over a top of the roof frame, into an interface between said top and an underside of a roof sheathing attached to said top, for securing the roof frame; a tie-down member including a first plate having a portion placed flat against the plate of the claw member, and a second plate connected to the first plate; a connection device connecting the first plate of the tie-down member to the plate of the claw member; and wherein at least a portion of the second plate of the tie-down member is placed flat against and mounted to a vertical surface of the support member regardless of various angular positions of the load bearing flange with respect to the vertical surface of the support member.

In accordance with another aspect of the present invention there is a kit for retrofit connection of a roof frame to a support member below the roof frame, the kit comprising a claw member having a substantially flat plate adapted for pressing flat against a side surface of the roof frame, and a substantially flat load bearing flange integrated with a top edge of the plate and extending transversely away from the plate to form a free extremity end, the load bearing flange adapted to be driven substantially over a top of the roof frame, into an interface between said top and an underside of a roof sheathing attached to said top, for securing the roof frame; a tie-down member including a first plate for being placed flat against and connected to the plate of the claw member and an opening defined through the first plate, and a second plate connected to the first plate, the second plate adapted to be mounted to a vertical surface of the support member; and a fastener for extending through an opening in the first plate of the tie-down member and an aperture in the plate of the claw member to connect the tie-down member to the claw member.

In accordance with a further aspect of the present invention, there is a method of retrofit connection of a roof frame to a support member below the roof frame, a roof sheathing being fastened down to a top of the roof frame, the method comprising (a) placing a claw member which has a plate and a load bearing flange integrated with a top edge of the plate and extending transversely away from the plate to form a free extremity end, against a side of the roof frame in a selected location wherein the plate is angularly oriented relative to, and with a low edge of the plate resting against, the side of the roof frame while the free extremity of the load bearing flange rests against the side of the roof frame immediately bounded by a underside of the roof sheathing, the free extremity aligning with an interface of the roof frame and the roof sheathing; (b) driving the load bearing member into the interface of the roof frame and the roof sheathing until the plate of the claw member comes to rest flat against the side of the roof frame; (c) placing a tie-down member such that a first portion of the tie-down member rests against the plate of the claw member and a second portion of the tie-down member rests on a vertical surface of the support member; and (d) securing the first portion of the tie-down member to the plate of the claw member and securing the second portion of the tie-down member to the vertical surface of the support member.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals.

DETAILED DESCRIPTION OF THE PREFERRED EMBODIMENT

Figure 2:
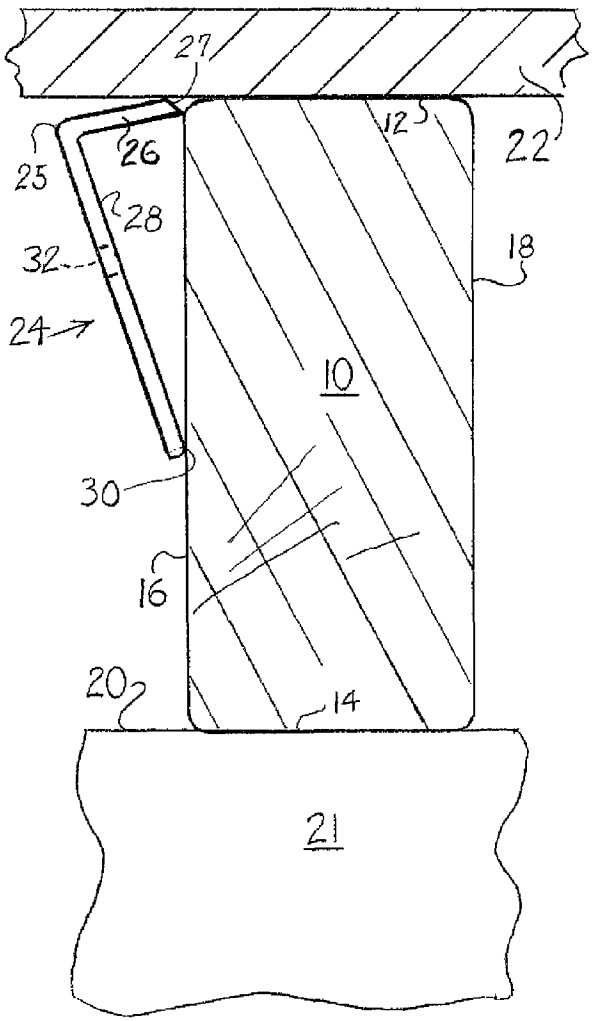
FIG. 2 is a cross-sectional view of the wood frame roof structure in which the claw member according to the embodiment of FIG. 1 is positioned ready for mounting to a roof frame.
Figure 1:
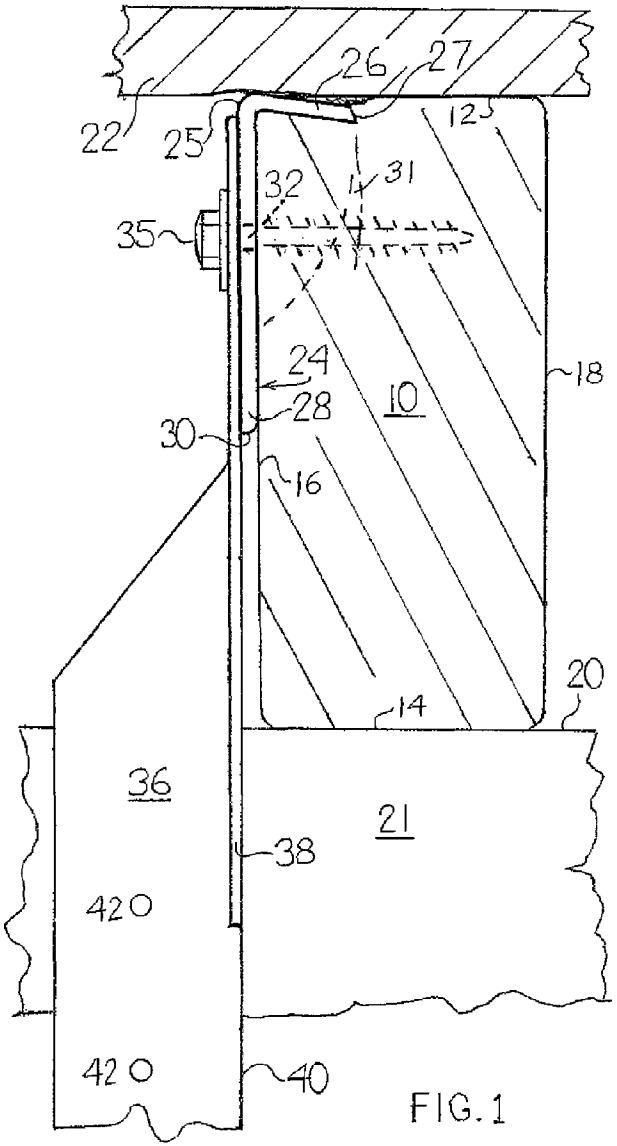
FIG. 1 is a cross-sectional view of a wood frame roof structure incorporating an embodiment of the present invention which includes a claw member and a tie-down member.
Figure 3:
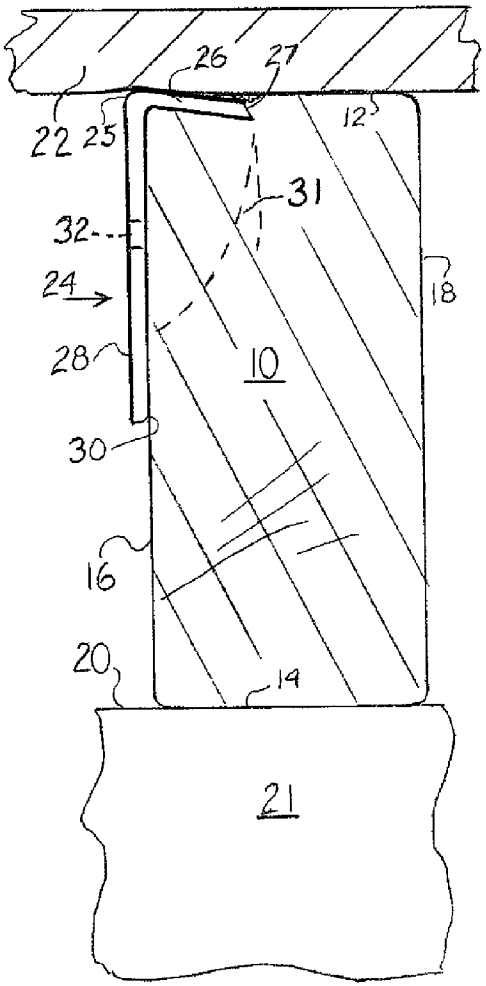
FIG. 3 is a cross sectional view of the wood frame roof structure in which the claw member of FIG. 2 is in a mounted position on the roof frame.

FIGS. 1, 2 and 3 illustrate an existing wood frame roof structure incorporating one embodiment of the present invention for reinforcing the connection of an existing roof frame to a support member such as a wall below, in a retrofit job. The frame member, which can be a truss or rafter type in general usage, is herein referred to simply as a roof frame 10 and is of conventional configuration such that the roof frame 10 is supported by an exterior underlying load-bearing wall 20 of a house or similar small building. The roof frame 10 has two opposed relatively narrow sides referred to as top and bottom edges 12 and 14 respectively, and two opposed relatively long sides 16 and 18. The underlying load-bearing wall 20 includes a substantially vertical outer surface 21. A roof sheathing panel 22 is attached to the top edge 12 of the roof frame 10, and represents the roof sheathing which supports the roofing material (not shown) and helps tie the roof frames 10 together.

FIG. 1 illustrates an apparatus (not numbered) for retrofit connection of the roof frame 10 to a support member such as the underlying wall 20. The apparatus includes a connector referred to as a claw member 24 which is shown in profile, and a tie-down member 36 removably connected to the claw member 24. The claw member 24 has a generally flat plate 28 and a generally flat load bearing flange 26 integrated with a top edge 25 of the plate 28, according to a preferred embodiment of the present invention. The load bearing flange 26 is substantially flat and extends transversely away from the plate 28 to form a free extremity 27. In this embodiment the load bearing flange 26 may be formed integrally with the mounting plate 28 to form an angle slightly less than a right angle, as shown. The free extremity 27 may be sharpened to form a blunt chisel edge as shown, while a bottom edge 30 of the plate 28 may be rounded at least at a side facing the side 16 of the roof frame 10, as explained below. An aperture 32 is formed transversely through a generally middle portion of the plate 28.

Referring now to FIG. 2, the claw member 24 is shown positioned in a selected location against the side 16 of the roof frame 10, ready for mounting on the roof frame 10. The plate 28 is angularly oriented relative to the side 16 of the roof frame 10, and with a low edge 30 of the plate 28 resting against that side, while the free extremity 27 of the load bearing flange 26 rests against the side 16 of the roof frame 10 immediately bounded by a underside of the roof sheathing panel 22, aligning with an interface of the roof frame 10 and the roof sheathing panel 22.

The angular orientation of the claw member 24 causes the load bearing flange 26 to tilt slightly upward as shown, such that the free extremity 27 is directed essentially into the interface between the roof frame 10 and the roof sheathing panel 22.

FIG. 3 illustrates the claw member 24 in its mounted position, in which the load bearing flange 26 has been driven into the interface between the top 12 of the roof frame 10 and the underside of the roof sheathing panel 22, such that the mounting plate 28 is pressed flat against the side 16 of the roof frame 10. In addition to helping direct the flange 26 to a position substantially over the top of the roof frame 10, the path presented by the interface reduces resistance to the driving action, so allowing a desirably large flange 26 to be driven readily and fully inward even where there are obstructions such as knots at the top 12 of the roof frame 10.

As stated earlier, the load bearing flange 26 may be formed integrally with the mounting plate 28 to form an angle slightly less than a right angle, as shown, so that the load bearing flange 26 is induced to cut slightly downward into the top 12 of the roof frame 10 as it is driven inwardly from its rest position shown in FIG. 2 to its mounted position shown in FIG. 3.

The free extremity 27 may be sharpened to a chisel-like point which makes it easier to drive the load bearing flange 26 inwardly, as will be discussed below. The sharpened free extremity 27 helps to ensure that the free extremity 27 cuts down into the top 12 of the roof frame 10 as it advances, and also reduces any tendency of the moving load bearing flange 26 to wedge the roof sheathing panel 22 significantly upward off the top 12 of the roof frame 10. The rounding of the bottom edge 30 of the mounting plate 28 also reduces any tendency of the bottom edge 30 to dig into the side 16 of the roof frame. Such digging-in action could cause the moving load bearing flange 26 to lift the roof sheathing 22 significantly upward, which lifting should be minimized. The downward-sloping stance of the load bearing flange 26 illustrated in FIG. 3, will help keep the load bearing flange 26 securely in place as wind forces push upward on the roof frame 10, against the restraining strength of the load bearing flange 26, which causes the flange 26 to flex slightly upward.

The material, for example galvanized steel, and thickness of the claw member 24 ensure that the whole claw member 24 is resistant to such flexing. The load bearing flange 26 advantageously transfers a restraining force downward into the roof frame 10 at the top edge 12 of the roof frame 10, causing a loading compression down across the wood grain through the greater part of the roof frame 10, thereby allowing a greater force to be exerted with no direct tensile component downward across the wood grain, and therefore greatly reduces the tendency to split and weaken the wood.

Premature failure of wood may be initiated generally along dotted lines as denoted by numeral 31 in FIGS. 1 and 3. The curved dotted line 31 shows generally where "rolling shear" failure between wood fibres can allow the wood of the roof frame 10 under the load bearing flange 26, to be pushed downward and outward, well before the cross-the-grain compression limit of the wood is reached. An upper vertical portion of dotted line 31 indicates premature splitting failure of the wood roof frame 10, where tensile forces have been induced generally horizontally across the grain by the loaded flange 26, further allowing the split portion (not numbered) of the roof frame 10 to move outward. The flat plate 28 of the claw member 24 may be additionally secured to the roof frame 10 in order to prevent such premature failure of the wood material of the roof frame 10, as further described below.

In FIG. 1, a lag screw type of fastener 35, for example, may be inserted through a hole 44 (see FIG. 5) of a tie-down member 36 and thence through the aperture 32 in the plate 28, and into the roof frame 10. A pre-drilling may be optionally conducted to avoid any wood splitting tendency of the roof frame 10. The fastener 35 thereby fastens the tie-down member 36 securely to the claw member 24, while also securing the claw member 24 firmly against the side 16 of the roof frame 10. The plate 28 thereby supports and restrains the upper corner portion of side 16 of the frame 10, preventing any wood failure due to rolling shear or splitting as generally denoted by the dotted lines 31 of FIGS. 1 and 3. The lag screw 35 may be driven almost entirely through the roof frame 10.

The fastener 35 could be a common wood screw or a through-bolt. The purpose of the fastener 35 is to pin the claw member 24 securely to the tie-down member 36 and to restrain the mounting plate 28 from moving outward under load. The fastener 35 need not take transverse load, and indeed the stiff action of the load bearing flange 26 will tend to minimize load transfer into the fastener 35, so that there is little or no tendency of the fastener 35 to split or otherwise weaken the roof frame 10.

It may be awkward to use a tool to drive the fastener 35 horizontally if the fastener 35 is positioned close to the roof sheathing panel 22. In practice, the fastener 35 may be driven inwardly and slightly upwardly into the roof frame, which provides convenience for operating a tool under the sheathing panel 22 and does not affect the function of the claw member 24 or the fastener 35.

As illustrated in FIG. 1, the tie-down member 36 according to this embodiment, may have a first vertical plate or strap 38 designed to have at least a portion thereof extending up to reach the roof frame 10 and being placed flatly on and connected to the plate 28 of the claw member 24, for example, by the fastener 35. The tie-down member 36 further includes a second vertical plate or strap 40 integrated with the first plate 38 and extending transversely away from a side edge of the first plate 38. However, the second vertical plate 40 may be otherwise connected to the first vertical plate 38.

In most cases the first and second plates 38, 40 may be normal to each other. The second plate 40 is designed to reach downward to be placed flat against the surface 21 of the wall 20 as illustrated in FIG. 1. The second plate 40 of the tie-down member 36 is mounted to the surface 21 of the wall 20 with one or more fasteners (not shown) received in one or more mounting holes 42 defined through the second plate 40. The thickness of the tie-down member 36 may generally be less than the thickness of the claw member 24.

Figure 4A:
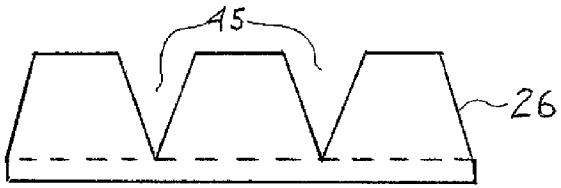
FIG. 4*a* is a top plan view of the claw member of FIG. 2, showing a load bearing flange thereof.

FIG. 4*a* illustrates an example of the load bearing flange 26 in plan view, in which the load bearing flange 26 defines one or more notches 45 extending inwardly from the chisel-shaped free extremity 27 thereof. The notches 45 facilitate driving the load bearing flange 26 into the interface between the roof sheathing panel 22 and the roof frame 10 and down into the top 12 of the frame 10. Furthermore, the notches 45 can help accommodate the rare instance where a roof sheathing nail (not shown) is encountered in the path of the advancing load bearing flange 26. In such an instance, the whole claw member 24 can be pried back out and simply moved a little to left or right along the roof frame 10, so that the advancing load bearing flange 26 now accommodates the nail's location within a notch 45 or misses the nail altogether.

Figure 4B:
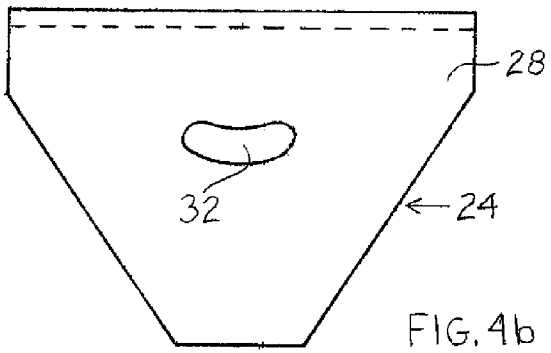
FIG. 4*b* is a side elevational view of the claw member of FIG. 2, showing a plate thereof with a slot opening.

In FIG. 4*b*, the aperture 32 in the plate 28 of the claw member 24, shown in this embodiment, is in an elongated shape, as a sideways-oriented slot, which offers a choice of location in the claw member 24 where the fastening point (hole 44, referring ahead to FIG. 5) of the tie-down member 36 is connected.

Figure 4C:
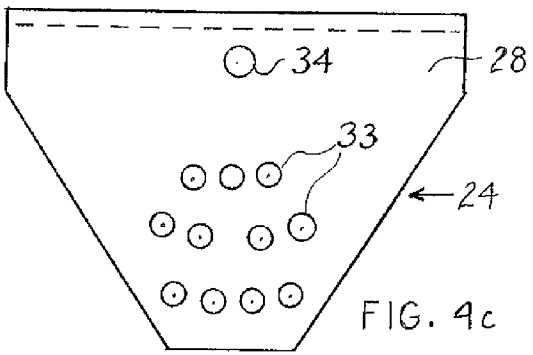
FIG. 4*c* is a side elevational view of an alternative claw member similar to that of FIG. 2, showing the plate thereof with an example array of openings as an alternative to the slot opening shown in FIG. 4*b;*

In FIG. 4*c*, the slot 32 shown in FIG. 4*b* has been replaced with an example alternative array of holes in the plate 28 of the claw member 24, wherein holes 33 underlie a single high-placed hole 34, again offering a choice in the mounting of the tie-down member 36, which will be described with reference to FIG. 6.

Figure 5:
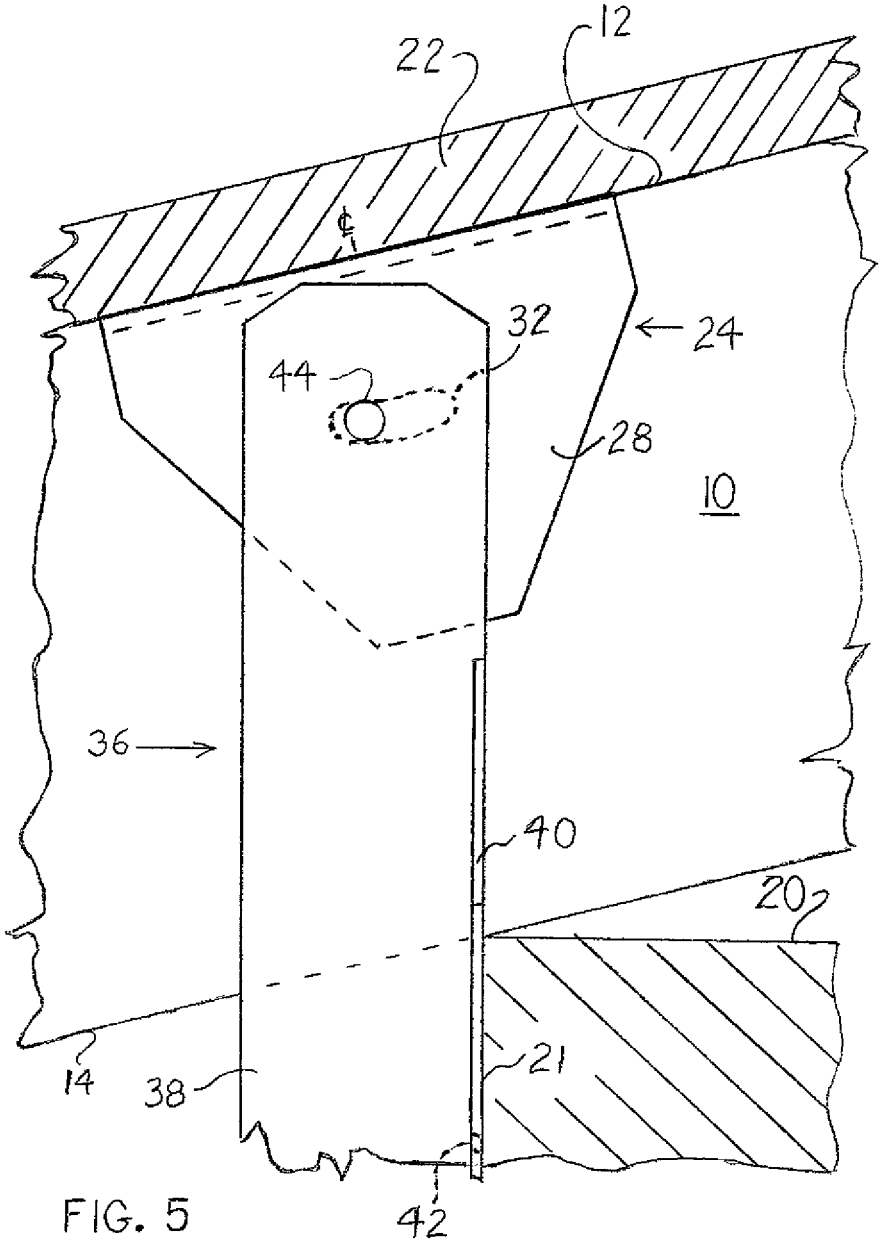
FIG. 5 is a cross-sectional view of the wood frame roof structure of FIG. 1 which exposes a partial side view of the roof frame, showing the mounted claw member and showing the tie-down member positioned ready to be secured to the claw member and to the wall below.

As shown in FIGS. 1-3 and 5, the claw member 24 is mounted on a sloped roof frame 10. The free extremity 27 of the load bearing flange 28 can substantially align with and point into the sloped interface of the roof sheathing panel 22 and the top 12 of the roof frame 10 and can be readily driven into the same interface between the roof sheathing panel 22 and the roof frame 10. The side elevational view of the roof structure of FIG. 5 illustrates that the first plate 38 of the tie-down member 36 has been placed flat against the plate 28 of the claw member 24 ready for connection, and extends down past the bottom edge 14 of the roof frame 10, while the second plate 40 has been placed flat against the vertical surface 21 of the wall 20 and can then be mounted to the wall 20 by fasteners (not shown), regardless of the selected angular position of the load bearing flange 26 with respect to the vertical surface 21 of the wall 20. The selected angular position of the load bearing flange 28 may vary to allow the free extremity 27 to align with the sloped interface in roof structures having different roof slopes.

It is somewhat desirable to position the mounting hole 44 of the tie-down member 36 such that the line of restraining force from the claw member 24 passes through or close to the centre of the load bearing flange 26, despite the angular position of the claw member 24 in relation to the slope of the roof, which positioning is enabled by the elongated side-to-side aperture 32 as shown in FIG. 5. It will be shown below, in reference to FIGS. 4*c* and 5, that an oblong slot aperture such as 32 (which entails significant manufacturing cost) may be replaced with simpler round hole options.

The embodiments shown in FIGS. 4*b* and 5 provide for just one connector 35 to hold the tie-down member 36 to claw member 24, which requires substantial thickness of the tie-down member 36 where it bears against the single connector 35 at the aperture 44, in order to withstand high wind loads. The plate 28 is already thick everywhere, including at its aperture 32 which is loaded equally to aperture 44, such thickness being demanded for bending rigidity of the flange 26 with the plate 28 at the bend 25, as explained above. The tie-down member 36 must generally therefore be thickened, or at least the area over and to the sides of aperture 34 must generally be thickened. Either way of thickening entails some costs.

Figure 6:
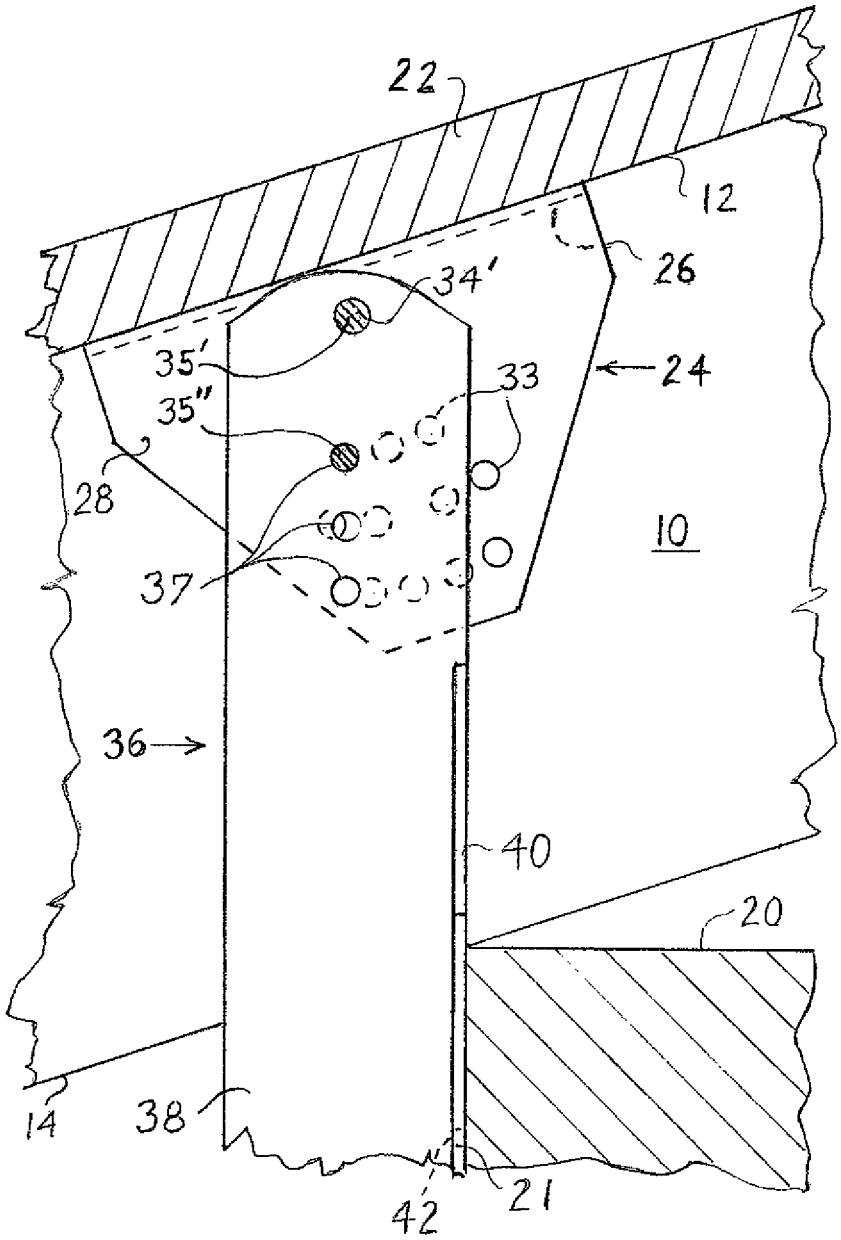
FIG. 6 is a cross-sectional view of the wood frame roof structure of FIG. 1 which exposes a partial side view of the roof frame, showing the alternative mounted claw member and showing the tie-down member positioned ready to be secured to the alternative claw member and to the wall below.

FIG. 6 shows one example of an alternative way of mounting the tie-down member 36 such that the line of restraining force from the claw member 24 passes through or close to the centre of the load bearing flange 26, despite the angular position of the claw member 24 in relation to the slope of the roof, by use of the array of holes 34 and 33 shown in FIG. 4*c*. The tie-down member 36 is here fitted with an uppermost hole numbered as 34' (to be connected through the hidden underlying hole 34 of the claw member 24) as shown in FIG. 6, and three lower holes 37 which offer one hole to connect through one hole of the array 33 in the claw member 24. The example array allows various roof slopes from flat to 5:12 slope to be accommodated. The hatched holes here denote connectors such as a rivet 35' and a screw 35" through the appropriate holes. This arrangement always provides for two connectors to secure the tie-down member 36 to the claw 24, so that no special thickening of the tie-down member should be required.

Further alternative arrangements of apertures (not shown) can combine a side-to-side slot in the claw member 24, much as shown as 32 in FIG. 4*b*, along with a high-placed hole such as indicated by 34 in FIG. 4*c*, allowing the fitting of the claw 24 to the roof slope while also affording at least two points of connection between the claw member 24 and the tie-down 36. The slot 32 is also placed suitably for driving a connector such as 35 deeply into the wood, as shown earlier in FIG. 1.

Embodiments such as shown in FIGS. 5 and 6 can be supplied in loose kit form, in which the claw member 24 and the tie-down member 36 are not yet connected to each other. The shape of the members is ideal for nesting when not yet connected, allowing for greatly reduced shipping bulk.

Optionally, the apparatus can be supplied in pre-assembled form in which claw member 24 and tie-down member 36 are pre-connected to each other. An arrangement such as shown in FIG. 6 is suitable for this, in which the pre-connection can be at a high point such as 34', allowing suitable mounting alignment of the whole apparatus as explained above. The pre-assembly option may afford some advantage in handling the apparatus when working on a ladder or scaffold, for example.

A rivet type of connector can be used wherever it is impractical or structurally undesirable to drive a connector substantially into the wood, such as through the high point 34', FIG. 6. Where the apparatus is pre-assembled, the pre-connection must be through a high point such as 34' in order to allow adequately aligned mounting of the apparatus, as explained above.

However, such pre-assembly can interfere somewhat with positioning the claw member 24 in the desired tilted position against the side 16 of the roof frame 10 as shown in FIG. 2. Clearly, any pre-connection of claw member 24 to the tie-down 36 must be loosely done to allow an initial tilting in which the tie-down member 36 may be rotated to a position substantially parallel to the roof frame 10 to allow the claw member 24 to be positioned. A loosely attached rivet (not shown) can meet this requirement.

Caution is needed to avoid damaging such rivet or any type of connector placed generally where indicated by numeral 34' in FIG. 6, when driving the free extremity 27 of the claw member 24 into the interface between the top 12 of the roof frame 10 and the roof sheathing panel 22, particularly when a hammer is employed to do so. After the plate 28 of the claw member 24 rests flatly against the side 16 of the roof frame 10 and the tie-down member 36 is also positioned vertically as similarly shown in FIG. 6, the rivet is impacted to securely complete this first connection of the tie-down member 36 to the claw member 24.

Referring generally to FIGS. 1, 5 and 6, the stiffness of the claw member 24 and the tight seating of the load bearing flange 26 itself against the wood below assures very stiff load-restraining action, with the claw member 24 taking a high portion of uplift load immediately (without needing pre-tensioning of the apparatus) and so advantageously sharing load with existing connectors (not shown) holding down the roof frame to the wall before they are unduly strained and lose significant strength.

Figure 7:
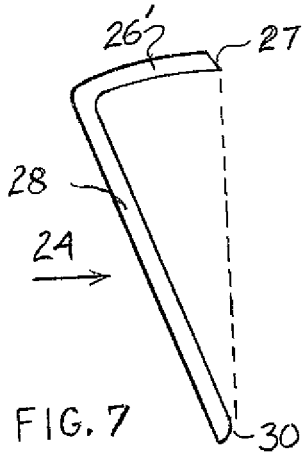
FIG. 7 is a side elevational view of the claw member showing an alternative shape of the load bearing flange.

FIG. 7 shows an alternative shape of the claw member 24 which has, in contrast to the load bearing flange 26 of FIGS. 1-3, a load bearing flange 26' in a curved cross section such that the sharpened free extremity 27 will cut downward as it is pushed into the final position over the top edge 12 of the roof frame 10 (not shown but similar to that shown in FIGS. 1-3). The centre of curvature of load bearing flange 26' is preferably at the bottom edge 30 of the claw member 24, with the radius of curvature as shown by the dotted line (not numbered) substantially equal to the length between the bottom edge 30 and the top edge 25 of the plate 28 of the claw member 24. Compared to the downwardly angled flat shape of load bearing flange 26 of FIGS. 1-3, such curvature of the load bearing flange 26' may slightly facilitate driving the flange into a final position, slightly improve its seating against backing out of position, and may also slightly improve the bearing of the flange against relatively smooth-cut wood beneath it.

The above description is meant to be exemplary only, and one skilled in the art, will recognize that changes may be made to the embodiments described without departure from the scope of the described subject matter. For example, the embodiments described above and illustrated in the appended drawings are most appropriate for low slope applications (i.e. no slope to 4/12 slope roofs). However, the geometry of the claw member 24 may be modified to accommodate steeper roof slope applications without undue misalignment of the load path through the flange claw. Also, various types of tie-down members may be used in combination with the connector of this application such as the claw member. Still other modifications which fall within the scope of the described subject matter will be apparent to those skilled in the art, in light of a review of this disclosure, and such modifications are intended to fall within the scope of the appended claims.

I claim:

1. An apparatus for retrofit connection of a roof frame to a support member, wherein the roof frame has a first side and a top edge and wherein the top edge of the roof frame abuts the underside of a roof sheathing, the apparatus comprising:

a claw member comprising a claw member plate configured to be secured to the first side of the roof frame, and a claw member flange extending from a first end of the claw member plate, wherein the free extremity end of the claw member flange is sharp to form a chisel configured for driving the claw member flange into the interface where the top edge of the roof frame abuts the underside of the roof sheathing; and a tie down member comprising a first tie down member plate configured to be secured to the first side of the roof frame and to the claw member plate.

2. The apparatus of claim 1, wherein the tie down member further comprises a second tie down member plate integrated with the first tie down member plate, wherein the second tie down member plate is configured to be secured to the support member.

3. The apparatus of claim 1, wherein the claw member plate further comprises a first aperture configured to receive a first fastener for securing the claw member plate to the first side of the roof frame.

4. The apparatus of claim 3, wherein the first tie down member plate further comprises a second aperture configured to receive the first fastener for securing the first tie down member plate to the first side of the roof frame and to the claw member plate.

5. The apparatus of claim 1, wherein the claw member plate is configured to be placed flat against the first side of the roof frame.

6. The apparatus of claim 1, wherein the first tie down member plate is configured to be placed flat against the claw member plate.

7. The apparatus of claim 1, wherein the angle between the first end of the claw member plate and the claw member flange is less than ninety degrees.

8. The apparatus of claim 1, wherein the claw member flange is generally flat.

9. The apparatus of claim 1, wherein the claw member flange is curved.

10. The apparatus of claim 1, wherein the claw member flange is configured to allow the claw member flange to be driven into the top edge of the roof frame.

11. The apparatus of claim 1, wherein the free extremity end of the claw member flange further comprises a notch.

12. The apparatus of claim 3, wherein the first aperture of the claw member plate comprises an elongated slot.

13. The apparatus of claim 3 wherein the claw member plate further comprises an array of apertures.

14. A method for retrofit connection of a roof frame to a support member, wherein the roof frame has a first side and a top edge and wherein the top edge of the roof frame abuts the underside of a roof sheathing, the method comprising the steps of:

positioning a free extremity end of a claw member flange proximate to the interface where the top edge of the roof frame abuts the underside of the roof sheathing, wherein the claw member flange extends from a first end of a claw member plate, and wherein the free extremity end of the claw member flange is sharp to form a chisel;

driving the free extremity end of the claw member flange into the interface where the top edge of the roof frame abuts the underside of the roof sheathing; and securing the claw member plate to the first side of the roof frame.

15. The method of claim 14, further comprising the step of securing a tie down member to the first side of the roof frame and to the claw member plate.

16. The method of claim 14, wherein the step of securing the claw member plate to the first side of the roof frame comprises the steps of:

inserting a first fastener through a first aperture in the claw member plate; and fastening the first fastener to the first side of the roof frame.

17. The method of claim 15, wherein the step of securing the claw member plate to the first side of the roof frame and the step of securing the tie down member to the first side of the roof frame and to the claw member plate comprises the steps of:

inserting a first fastener through a first aperture in the claw member plate;

inserting the first fastener through a second aperture in the tie down member; and fastening the first fastener to the first side of the roof frame.

18. The method of claim 15, further comprising the step of securing the tie down member to the support member.

19. The method of claim 14, wherein the step of driving the free extremity end of the claw member flange into the interface where the top edge of the roof frame abuts the underside of the roof sheathing further comprises the step of driving the free extremity end into the top edge of the roof frame.

20. The method of claim 14, wherein the step of driving the free extremity end of the claw member flange into the interface where the top edge of the roof frame abuts the underside of the roof sheathing further comprises driving the free extremity end until the claw member plate comes to rest flat against the first side of the roof frame.

* * * * *